US005173569A

United States Patent [19]

Pallanck et al.

[11] Patent Number: 5,173,569

[45] Date of Patent: Dec. 22, 1992

[54] DIGITAL DELAY DETONATOR

[75] Inventors: Robert G. Pallanck, Windsor; Kenneth A. Rode, Collinsville, both of Conn.

[73] Assignee: The Ensign-Bickford Company, Simsbury, Conn.

[21] Appl. No.: 730,275

[22] Filed: Jul. 9, 1991

[51] Int. Cl.[5] ..... F42C 11/02

[52] U.S. Cl. ..... 102/210

[58] Field of Search ..... 102/200, 206, 210, 218, 102/220

[56] References Cited

U.S. PATENT DOCUMENTS

| | | | |
|---|---|---|---|
| 3,320,890 | 5/1967 | Ciccone et al. | 102/210 |
| 3,340,811 | 9/1967 | Gauld | 102/210 |
| 3,941,058 | 3/1976 | Gawlick et al. | 102/210 |
| 3,987,729 | 10/1976 | Andrews et al. | 102/210 |
| 4,311,096 | 1/1982 | Oswald | 102/220 |
| 4,328,751 | 5/1982 | Oswald | 102/220 |
| 4,393,779 | 7/1983 | Brede et al. | 102/210 |
| 4,395,950 | 8/1983 | Oswald | 102/218 |
| 4,586,437 | 5/1986 | Miki et al. | 102/220 |
| 4,730,558 | 3/1988 | Florin et al. | 102/218 |

FOREIGN PATENT DOCUMENTS

| | | |
|---|---|---|
| 2206646 | 8/1972 | Fed. Rep. of Germany . |
| 88000409 | 8/1988 | PCT Int'l Appl. . |
| 9200498 | 1/1992 | World Int. Prop. O. . |

*Primary Examiner*—Charles T. Jordan
*Attorney, Agent, or Firm*—Hayes & Reinsmith

[57] ABSTRACT

An electrical delay detonator for blasting initiation systems and the like energized solely by a force input from a non-electric signal communication system, which detonator has a hollow, electrically conductive housing enclosing a booster charge connected to the source of non-electric input force, a transducer positioned in force communicating relationship with the booster charge for converting the output force from the booster charge to an electrical output signal, an electrical circuit connected to the output of the transducer for introducing a time delay in the electrical output from the transducer and an electrically operable igniter element.

16 Claims, 5 Drawing Sheets

DIGITAL DELAY DETONATOR

This invention relates to detonators for blasting products and is directed to an improved detonator having particular use with nonelectric blasting initiation systems to provide a very accurate time delay before initiation of the blasting product.

BACKGROUND OF THE INVENTION

Efficient use of explosive energy in blasting to obtain the desired fragmentation and movement of ore and rock continues to be inhibited by restrictions intended to reduce the effect of the blast on nearby structures by minimizing ground vibrations and air blast; delay blasting has been developed to sequence the detonation of the explosives in each hole to increase safety while reducing environmental impact. It has been found however that most of the electric or nonelectric blasting caps and initiators utilize internal pyrotechnic delay elements with the desired delay timing being determined by burn speed of the pyrotechnic composition. As a result, time scatter develops because of variation in burn speed and in the extreme situation, can cause blast holes to detonate out of sequence resulting in significantly increased vibration, poor fragmentation and excessive noise and danger to personnel.

Sequential blasting machines have been developed utilizing electrical circuitry to provide precisely timed initiation pulses to electric blasting caps. The accuracy of the electrical pulses from the sequential blasting machine can be very accurate so as to virtually eliminate timing scatter but electric connections between the blasting cap and the blasting machine must be maintained; broken or shorted connections often lead to undetonated explosives and the hazards resulting therefrom. Moreover, unintended detonations in such electrical systems can be produced by stray electric ground currents, as well as induced currents from magnetic fields from high voltage wires, broadcast stations, radio transmitters and the like.

It has become common to eliminate the hazard attendant to electric blasting caps through utilization of nonelectric transmission lines and nonelectric delay detonators but such systems using, for example, detonating cord on the surface of the blast pattern produces objectionable air blast noise and above-ground noise.

Many efforts have been made by the prior art in endeavoring to solve the multiplicity of noted problems. One such recent prior art attempt to solve the problems is found in PCT Publication No. WO89/01601, the published version of PCT application No. PCT/SE 88/00409 wherein the inventor discloses in very general terms a technique for electronically delayed ignition of an explosive charge based upon input from detonating cord acting upon a piezoelectric element; while that ignition system has a principal purpose to generally eliminate the effect of stray electromagnetic fields and other electrical energy sources, it appreciates the known use of piezoelectric devices with igniters. Piezoelectric driven electrically delayed squib initiators are well-disclosed in U.S. Pat. No. 3,340,811 and a variety of electric delay circuits are to be found in U.S. Pat. Nos. 4,328,751, 4,395,950 and 4,730,556.

OBJECTS OF THE INVENTION

It is a primary object of this invention to provide a delay detonator for blasting products by utilizing substantially noiseless shock tube to energize a delay detonator whose timing is accurately controlled by a digital electronic circuit.

It is a further object of this invention to provide an improved detonator that is substantially insensitive to electromagnetic and electrostatic fields, stray currents, etc. yet which provides precise timing of the initiation of the detonator by using of a digital electronic control circuit.

It is a still further object of this invention to provide a wide variety of distinct delays between input of energy from the shock tube to initiation of the detonator (and associated explosives) with a device which is easy to use, substantially insensitive to the environment and sufficiently low in cost that it can be incorporated into a nonelectric blasting system without requiring highly skilled workers while providing user safety.

It is also an object of this invention to provide improved structure for a delay detonator that provides structural and environmental integrity at low cost.

It is also an object of this invention to provide an improved electrical circuit for use in such a delay detonator.

It is a still further object of this invention to provide a delay detonator having improved environmental acceptability obtained by eliminating pyrotechnic delays and the environmental contaminants associated therewith.

Other objects will be in part obvious and in part pointed out in more detail hereinafter.

A better understanding of the objects, advantages, features, properties and relations of the invention will be obtained from the following detailed description and accompanying drawings which set forth certain illustrative embodiments and are indicative of the various ways in which the principles of the invention are employed.

SUMMARY OF THE INVENTION

In its preferred embodiment, the digital delay detonator of this invention includes a tubular conductive housing closed at one end with the other end sealed to the shock tube. The energy output of the shock tube energizes a booster charge whose energy output is directed to a piezoceramic transducer to produce an electrical energy output to a time delay circuit, the time delay circuit serving to control an ignition signal to an igniter element following expiry of the predetermined delay.

DETAILED DESCRIPTION OF THE PREFERRED EMBODIMENT

Figure 1:
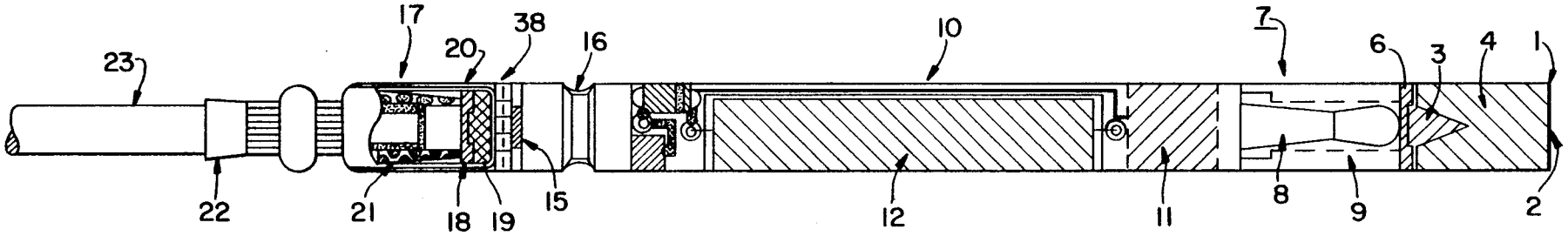
FIG. 1 is a partial cross-section view showing a preferred embodiment of the detonator of this invention connected to a shock tube.

The preferred embodiment of the delay detonator of this invention is shown primarily in cross-section in FIG. 1 and comprises a generally tubular electrically conductive aluminum shell 1 having a closed end 2 into which is pressed a quantity of primary explosive 3 and a secondary explosive 4 in juxtaposition therewith. The cushion element 6 is positioned on top of the primary explosive, such as lead azide, the secondary explosive being an explosive such as PETN or RDX; cushion element 6 acts as a resilient buffer during manufacturing assembly and shipping. During manufacture, a hard steel pressing pin extends through the open end of the aluminum cylinder 1 to engage the primary explosive 3 and, moreover, it is quite common that sub-assemblies may be shipped and handled extensively. Hence, a cushion element of the type shown in U.S. application Ser. No. 608,688, filed Nov. 5, 1990 and assigned to the assignee of the present invention is used.

Juxtaposed with the cushion element is a suitable electric fuse head assembly generally designated 7, the fuse head assembly having an ignition element 8, which ignition element is positioned within a semi-conductive resin bushing 9. A variety of ignition elements are discussed in connection with FIG. 4.

In order to provide the desired time delay, a digital delay module generally designated 10 is provided within aluminum housing 1 and includes delay timing means 11 and at least one storage capacitor 12, the delay module 10 being encased within a suitable potting compound to provide protection from external physical shock and other environmental conditions. The electrical power source is a multi-layer piezoceramic (piezoelectric) assembly generally designated 15, which piezoceramic assembly is electrically connected to the delay module 10 and securely crimped in place at 16.

As hereinafter explained in greater detail, the piezoceramic generator assembly generally designated 15 is of the low output energy type and a booster detonator generally designated 17 is positioned substantially in juxtaposition with the load distributing disc 38 which in turn is juxtaposed with piexoceramic 15. Booster element 17 generally comprises a small quantity of primary explosive 19 pressed into booster detonator shell 20. Cushion disc 18 is positioned on top of the primary explosive, such as lead azide; the cushion element acting as a resilient buffer during manufacture of the booster detonator. Juxtaposed with cushion disc 18, in turn, is the isolation cup 21 and rubber adaptor bushing 22. Shock tube 23 is inserted into the adaptor bushing 22 and shock tube 23 and bushing 22 are secured together and to the entire assembly by crimping the booster shell 20 and aluminum shell 1 simultaneously to a smaller diameter to effect both an environmental seal and isolating the elements of the booster detonator from electrical influence.

It should be understood, however, that other non-electric signal transmission devices such as detonating cord, low energy detonating cord, low velocity shock tube, etc. may be used as inputs pursuant to this invention. It must be remembered, however, that the input signal transmission device, the booster detonator and the piezoceramic generator are mutually dependent elements which act in concert to provide the desired electrical input to the digital delay module; hence transmission power in and piezoceramic characteristics must be properly interfaced by booster power.

Having described the basic combination, it is important to understand the reasons for using the booster detonator 17 in combination with the incoming non-electric initiation tube 23.

The use of a booster detonator as an energy interface in applicant's detonator is preferred over all other types of direct signal initiation including electrical wiring, direct discharge from a shock tube, and/or a detonating cord, etc. In the first place there is the very obvious advantage of eliminating the problems associated with electrical detonators such as stray currents, complicated electrical firing, blasting machines, circuitry, etc. The equally important and unobvious advantage of using a booster detonator in combination with a multi-layer piezoceramic electrical generator is that it is now possible to use, for example, low energy shock tube and a comparatively insensitive piezoceramic device producing the desired output energy thereby providing a combination device which is substantially insensitive to being "activated" by the normal conditions attendant to loading a bore hole as well as from the normal shock waves that emanate from adjacent bore hole detonations. Thus, using a low energy level piezoceramic in combination with the low energy level output of the shock tube is a reliable link in the force chain only by using a booster detonator thereby permitting initiation with the desired reliability in substantial silence.

Figure 5:
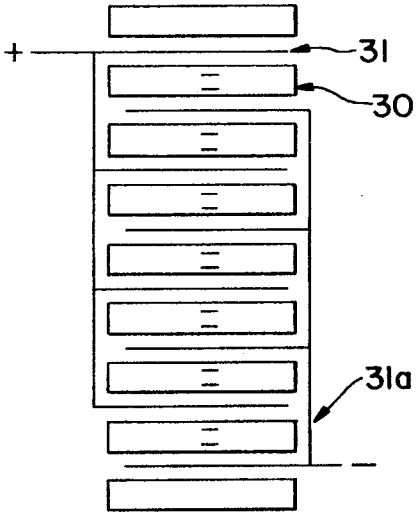
FIG. 5 is a schematic view of the laminated piezoceramic transducer of the present invention.
Figure 7:
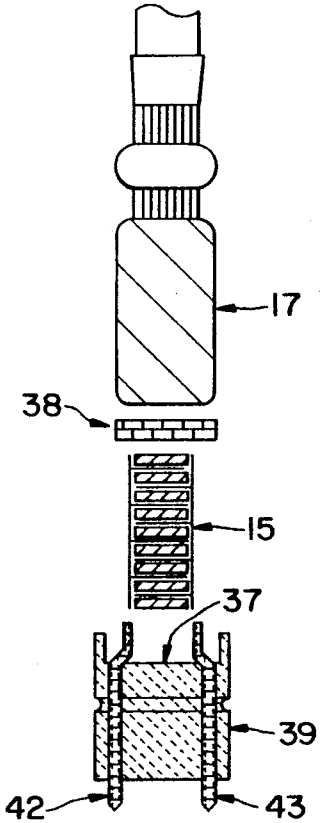
FIG. 7 is a partial exploded cross-section view of the apparatus of FIG. 6.
Figure 6:
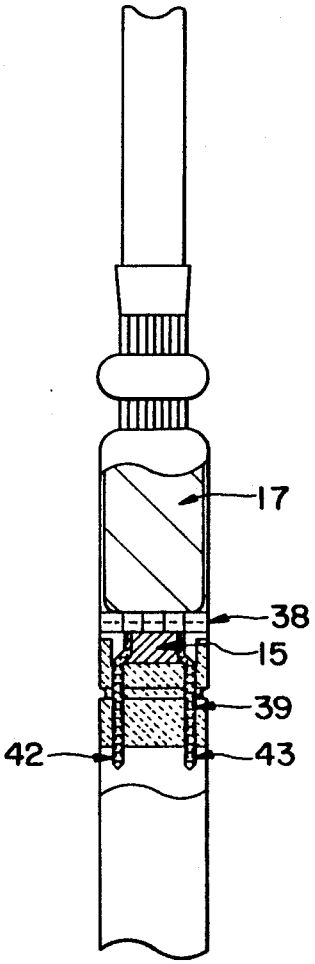
FIG. 6 is a schematic cross-section view showing the general construction and arrangement of the piezoceramic transducer of this invention with associate structure.

As best seen in FIGS. 5, 6 and 7, the output energy from the booster detonator 17 impinges substantially directly upon the load distributing disc 38, which in turn evenly transmits said energy from the booster detonator 17 to the multiple layers 30 of suitable thin piezoceramic material, which multiple layers are supported in a plastic housing. As best seen in the schematic representation of FIG. 5, the piezoceramic material 30 is stacked in vertical layers with opposite faces of each layer connected in parallel through the use of electrode layers 31 and **31*a* interposed between each layer or element 30. In the preferred embodiment, the piezoceramic generator of the present invention uses 84 active layers approximately 20 microns thick with discrete positive and negative electrodes as marked on FIG. 5** formed from the inner connections, with output energy levels much greater than those which can be obtained from a comparable monolithic piezoceramic.

Referring particularly to FIGS. 5, 6 and 7, the plastic housing 39 and load distributing disc 38 are important elements in this electrical generator. To obtain the maximum benefit from the output shock wave of the booster charge 17 and the physical pressure attendant thereto, piezoceramic generator 15 is mounted to a smooth, flat and hard surface shown at 37 in FIG. 7. Plastic housing 39 provides a surface 37 substantially parallel to the shock wave front from booster charge 17 and perpendicular to the direction of shock wave travel. To further obtain maximum benefit from the output shock wave of the booster charge 17, the load distributing disc 38 is interposed substantially parallel between the output end of the booster charge 17 and the input face of the piezoceramic generator to evenly transmit and distribute the output shock wave energy of the booster charge 17 to the piezogenerator 15 to prevent premature shattering of the piezogenerator (and render the piezoceramic generator inoperable). Terminals 42 and 43 are electrically connected to electrode layers 31 and **31*a* to establish the desired electrical connection to the digital delay module 10. Plastic housing 39 and load distributing disc 38 also serve to insulate piezoceramic 15** against unintended and random mechanical forces, any electric charges, etc. and serves to maintain the piezoceramic in the desired position.

Figure 3:
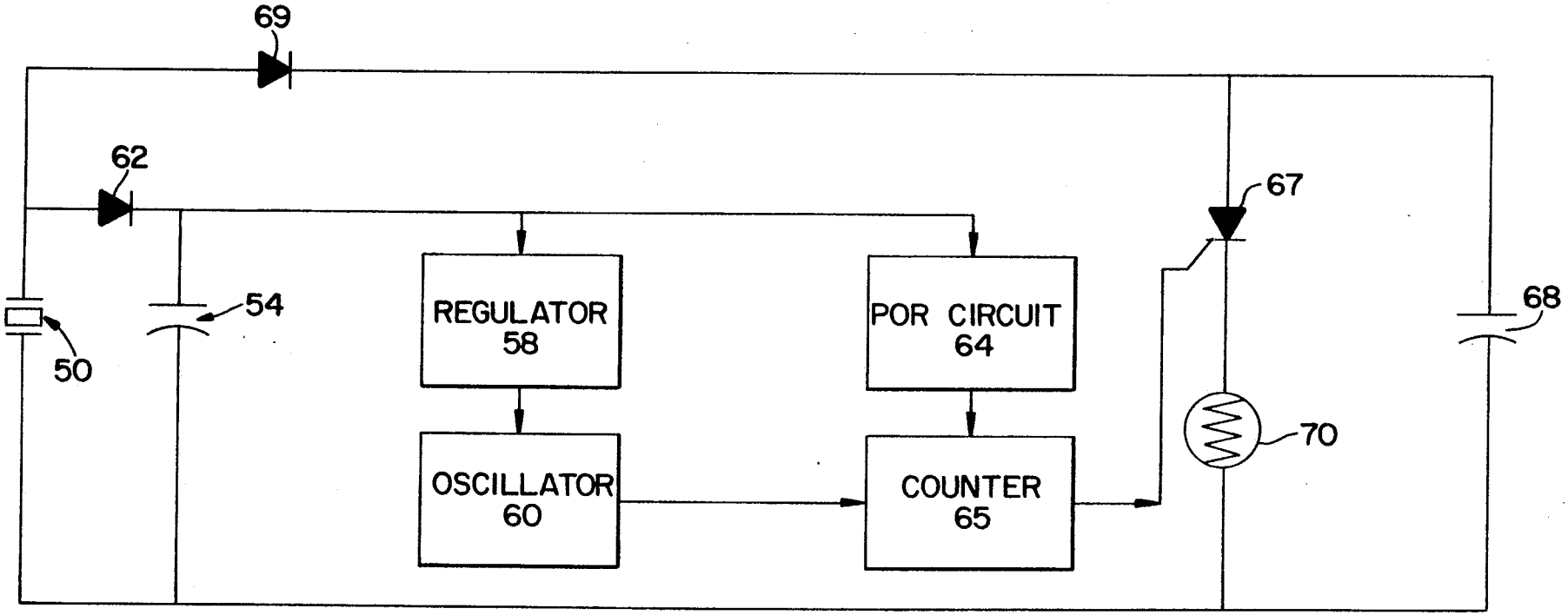
FIG. 3 is a schematic circuit diagram showing one embodiment of the delay ignition circuitry of this invention.
Figure 4B:
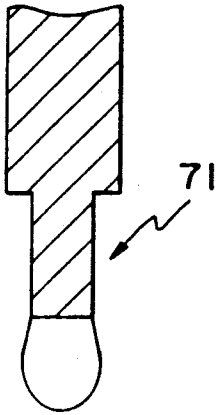
FIG. 4 is schematic cross-section view showing various ignition devices.
Figure 4D:
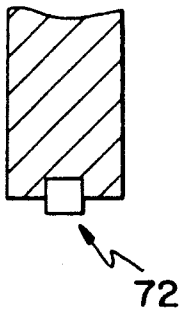
Figure 4A:
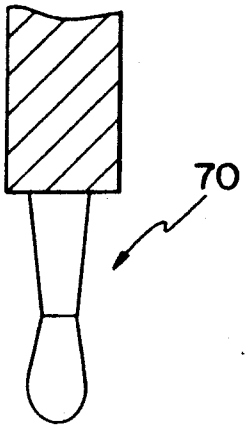
Figure 4C:
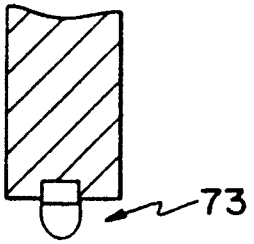

FIG. 3 shows a block diagram of a preferred embodiment of the electronic delay circuit of this invention. Upon activation of the piezoceramic energy transducer 50, current flows through the steering diode 52 to charge the storage capacitor 54. Transducer 50 is also connected to firing capacitor 68 through diode 69 and provides charging current to it, also. The regulator 58 provides a substantially constant voltage source to the oscillator 60 to control the frequency of the oscillator 60. The "power-on reset" (POR) circuit 64 preloads the counter 65 upon initial application of input voltage. Once the voltage on the storage capacitor 54 has increased beyond a threshold setting, counter 65 begins decrementing upon each input pulse from the oscillator. As counter 65 digitally decrements past zero, the output to the firing switch 67 is activated and all remaining energy in the aforementioned circuit as well as the energy stored in the firing capacitor 68 through isolation diode 69 is applied to the igniter element 70.

The electrical energy produced by piezoceramic generator 50 is of an extremely rapid time pulse (approximately 2 microseconds), with a current pulse of approximately 80–150A. The preferred circuit (variable according to its design) provides a delay time of up to 10 seconds before firing the igniter, which firing is accomplished by feeding the current pulse from capacitor 68 which is switched by the timing module to provide energy to the igniter element 70. It has been found that, for one time, short duration usage, the published electrical ratings of the capacitors and other components may be greatly exceeded; hence, the physical size of the components may be reduced to the point where installation into a standard size blasting cap shell is possible.

Figure 2:
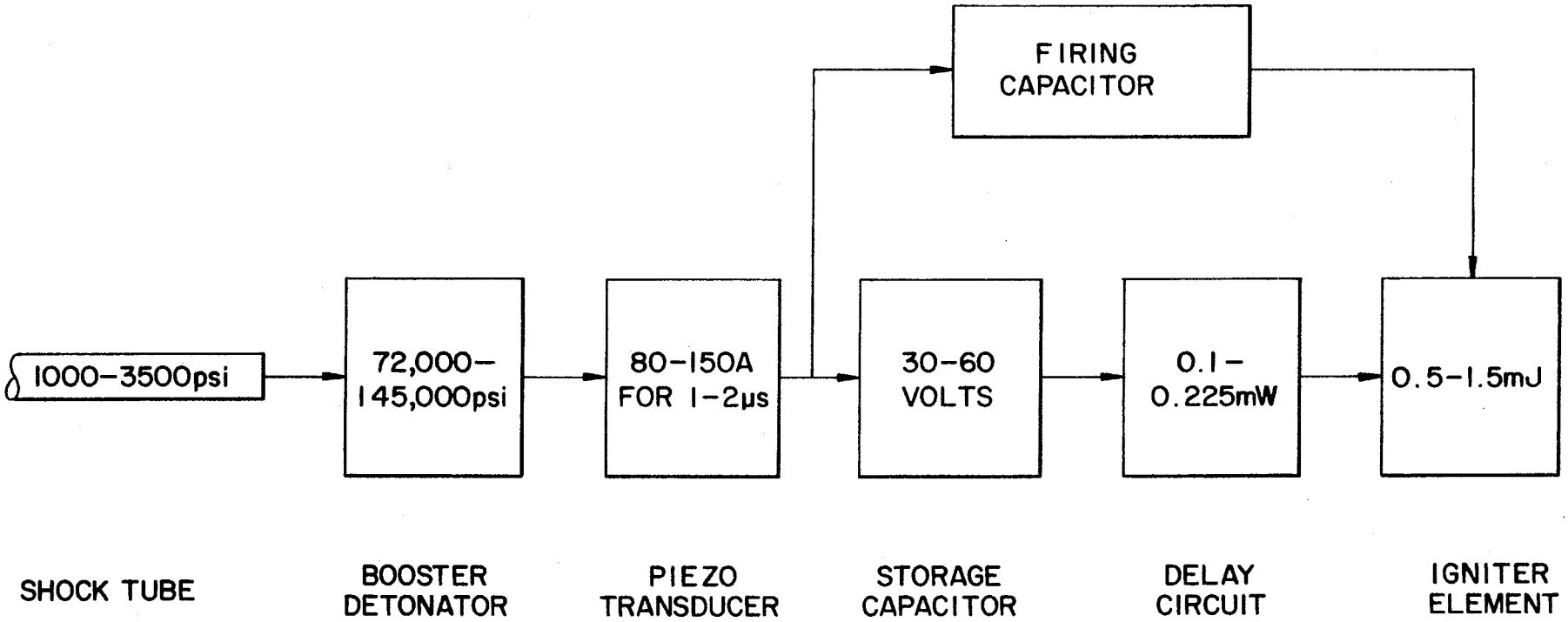
FIG. 2 is a block diagram showing the force train within the detonator of this invention.

The functioning and advantages of the present invention will be better appreciated from an analysis of the approximate range of the force train inherent in this invention. Turning to FIG. 2, a labeled block diagram shows the delay detonator used with the shock tube which transmits an initiating signal of 1000 to 3500 psi to a booster detonator which, upon firing, produces signal amplification to a range of 72,000 to 145,000 psi. As the shock wave from the booster detonator contacts the piezoceramic generator assembly a current pulse of 80 to 150 amps is generated for 1 to 2 microseconds. The resultant 30 to 60 Volts of electrical potential charges the storage capacitor (for operation of the delay timing means) and the firing capacitor; in effect, by using a firing capacitor, the delay circuit does not diminish the energy available to the igniter. An embodiment of the delay timing circuit has a power requirement of 100 to 225 microwatts for up to 10 seconds, which, after time-out, permits discharge of the energy remaining in the timing circuit and the energy stored in the firing capacitor to the igniter assembly. Upon receipt of 0.5 to 1.5 milliJoules of electrical energy, the selected igniter assembly will cause the primary explosive to detonate and subsequently initiate the secondary explosive.

All of the functional components depicted in FIG. 2 as well as the other drawings are encased in a metallic shell to significantly reduce susceptibility of the detonator to spurious ignition by ratio frequency energy (such as broadcast stations, 2-way radio, etc. This encasement acts as a Faraday Cage to shield all of the electronic components from external influences.

Many types of igniter elements are available for use within the digital delay detonator. Some of the possible types are shown in FIG. 4 and include, common 1 milliJoule matchheads 70, bridgewires 71, semiconductor bridgewires 73 and laser diode 72 bonded to the end of the printed circuit board to directly initiate the primary explosive through the heat and light from it's coherent laser output.

It is of course possible and may be desirable to utilize the output of the firing capacitor to effect direct initiation of either a primary or secondary explosive depending of course upon the materials selected and the nature of the problems presented.

Use of a semiconductive materal for mounting bushing prevents any stray voltage from accumulating on the igniter and causing unplanned ignitions.

As will be apparent to persons skilled in the art, various modifications, adaptations and variations of the foregoing specific disclosure can be made without departing from the teachings of this invention.

We claim:

1. An electrical delay detonator for blasting initiation systems energized substantially solely by a force input from a non-electric signal communication system comprising:

a hollow electrically conductive housing enclosing the electrical delay detonator, said housing being closed at one end and open at the other end for end-wise connection to a source of non-electric input force connected to the open end;

a booster charge positioned in said housing for activation by said non-electric input force;

a transducer for directly converting the output force from the booster charge to an electrical output signal, said transducer being positioned adjacent to and in force communicating relationship with said booster charge;

said transducer being substantially insensitive to environmental shock forces and sensitive substantially only to the output force of such booster charge;

an electrical circuit connected to the output of said transducer for introducing a time delay in the electrical output from said transducer relative to the output signal from said electrical circuit; and an electrically operable igniter element including means connecting said igniter element to the electrical output of said electrical circuit whereby said igniter is electrically energized after expiry of a time interval between force input to the transducer and electrical output from the electrical circuit.

2. The apparatus of claim 1 wherein said transducer is piezoelectric means rigidly supported in a non-conductive member fixed in position in said electrically conductive housing in juxtaposition with said booster charge.

3. The apparatus of claim 1 wherein the force input to the booster is received from a shock tube, the open end of said conductive housing being connected and sealed to the open end of the shock tube.

4. The apparatus of claim 1 wherein the electrically operable igniter element is supported by a semi-conductor element in electrical contact with said conductive housing thereby to reduce the effect of stray electrical signals.

5. The apparatus of claim 1 wherein the transducer is a multi-layer piezoceramic device with the layers being electrically connected in parallel to two output terminals, the layers being supported in a non-conductive support member positioned within the housing to accept the force from the booster in a direction substantially perpendicular to the major surface of each layer but to be substantially insensitive to environmental shock forces.

6. The apparatus of claims 1, 2, 3, 4 or 5 wherein a secondary explosive charge and a primary explosive charge are positioned adjacent the closed end of said housing and the output of the igniter element causes detonation of the primary and secondary explosive charge.

7. The apparatus of claim 5 wherein the electrically operable igniter element is supported by a semi-conductor element thereby to reduce the effect of stray electrical signals.

8. The apparatus of claim 5 wherein a load distributing disc is placed between the booster and the piezoceramic device thereby to reduce the opportunity for shattering of the transducer by the booster output force.

9. An electrical delay detonator energized by a shock tube force input comprising:

a length of shock tube capable of generating an output force, a hollow tubular electrically conductive housing closed at one end and open at the other, said length of shock tube being sealed to the open end of said housing thereby to communicate the shock tube output force;

said housing containing a booster detonator arranged for energization by the output force of the shock tube to produce a booster output force in the range of 72,000 psi to 145,000 psi, a multi-layer piezoceramic electric transducer juxtaposed with said booster to receive the booster output shock wave substantially perpendicular to the major plane of the layers of the transducer to produce an electrical output in the range of 80 to 150 amperes for a time pulse in the range of 1 to 2 microseconds, electric storage capacitor means; the output of said piezoceramic transducer being connected to charge said storage capacitor means;

the output of said storage capacitor means being connected to a delay circuit, the output of the delay circuit occurring after a preset time period, said delay circuit output being connected to control energization of an igniter element operable to effect energization of the detonator.

10. The apparatus of claim 9 wherein the electrically operated igniter element is supported on a semi-conductor mount and the tubular housing is formed from metal to provide electrical and electromagnetic shielding.

11. The apparatus of claim 9 wherein the transducer is a multi-layer piezoceramic device with the layers being electrically connected in parallel so as to produce two output terminals, the layers being supported in a non-conductive support member and positioned by the support member within the housing to receive the force from the booster in a direction substantially perpendicular to the major surface of each layer.

12. The apparatus of claim 9 wherein said storage capacitor means further comprises two capacitors charged by said transducer, one of said capacitors discharging into said delay circuit and the output of the other capacitor being switchable by the output of said delay circuit to energize the igniter element.

13. An electrical delay detonator for blasting initiation systems energized substantially solely by a force input from a non-electric signal communication system comprising:

a hollow housing enclosing the electrical delay detonator, said housing being closed at one end and open at the other end for end-wise connection to a source of non-electric input force connected to the open-end;

a booster charge positioned in said housing for activation by said non-electric input force;

a transducer for directly converting the output force from the booster charge to an electrical output signal, said transducer being positioned adjacent to and in force communicating relationship with said booster charge;

said transducer being substantially insensitive to environmental shock forces and sensitive substantially only to the output force of such booster charge;

an electrical circuit connected to the output of said transducer for introducing a time delay in the electrical output from said transducer relative to the output signal from said electrical circuit; and an electrically operable igniter element including means connecting said igniter element to the electrical output of said electrical circuit whereby said igniter is electrically energized after expiry of a time interval between force input to the transducer and electrical output from the electrical circuit.

14. The apparatus of claim 13 wherein said transducer is piezoelectric means rigidly supported in a non-conductive member fixed in position in said housing in juxtaposition with said booster charge.

15. The apparatus of claim 14 wherein the transducer is a multi-layer piezoceramic electric transducer juxtaposed with said booster to receive the booster output shock wave in a direction substantially perpendicular to the major surface of each layer.

16. The apparatus of claim 13 wherein the transducer is a multi-layer piezoceramic device with the layers being electrically connected in parallel so as to produce two output terminals, the layers being supported in a non-conductive support member and positioned by the support member within the housing to receive the force from the booster in a direction substantially perpendicular to the major surface of each layer.

* * * * *